United States Patent [19]

Poloni

[11] Patent Number: 4,948,363

[45] Date of Patent: Aug. 14, 1990

[54] QUICK-CHANGE COOLING LINE

[75] Inventor: Alfredo Poloni, Redipuglia, Italy

[73] Assignee: Danieli & C. Officine Meccaniche SpA, Buttrio, Italy

[21] Appl. No.: 268,249

[22] Filed: Nov. 7, 1988

[30] Foreign Application Priority Data

Nov. 23, 1987 [IT] Italy ..... 83493 A/87

[51] Int. Cl.[5] ..... F27D 15/02

[52] U.S. Cl. ..... 432/77; 432/78; 432/81

[58] Field of Search ..... 432/77, 78, 81, 85

[56] References Cited

U.S. PATENT DOCUMENTS

| | | | |
|---|---|---|---|
| 3,105,863 | 10/1963 | Holcroft et al. | 432/77 |
| 4,065,252 | 12/1977 | Hemsath et al. | 432/77 |
| 4,128,379 | 12/1978 | Hartitz et al. | 432/77 |

FOREIGN PATENT DOCUMENTS

| | | |
|---|---|---|
| 2151210 | 4/1937 | Fed. Rep. of Germany . |
| 2333593 | 5/1974 | Fed. Rep. of Germany . |
| 58-221610 | 12/1983 | Japan . |

*Primary Examiner*—Henry C. Yuen

*Attorney, Agent, or Firm*—Wegner & Bretschneider

[57] ABSTRACT

Quick-change cooling line which is located advantageously downstream of a finishing unit (11) and is suitable to cool round or ribbed wire rod having a section between 4 and 25 mm., the line consisting of a plurality of segments (110) each of which comprises cooling assemblies (15), assemblies (16) performing cleaning with water and possible drier assemblies (17), each organized plurality of segments being specially prepared (210-310-410-510) for a limited range of dimensions and cooperating with a rolling axis (14) when in the cooling position, whereby at least two specific sgements (210–310) having specialized ranges of different dimensions for the wire rod passing through are able to cooperate with the rolling axis (14) alternately.

12 Claims, 4 Drawing Sheets

QUICK-CHANGE COOLING LINE

This invention concerns a quick-change cooling line employed in the rolling of metallic wire rod. To be more exact, the invention concerns in particular the cooling lines for wire rod which are positioned downstream of compact wire-finishing units and upstream of coiling units.

The invention concerns, in general, all the lines to cool hot wire rod which cooperate with a line producing metallic wire rod, whether such wire rod is cylindrical or deformed superficially, the wire rod being of a type for building work for instance.

By wire rod is meant a long product having a section with a diameter between 4 and 20–25 mm.

Cooling lines for wire rod are known in very varied forms in the state of the art. They consist normally of a plurality of tubular conduits having a substantially tapered inlet with which water under pressure cooperates.

These conduits are positioned aligned and coaxial with each other and are usually arranged in groups, each group forming a cooling segment.

Each cooling segment includes an assembly to eliminate by counterpressure the water remaining on the wire rod passing through and also includes an assembly to dry the wire rod.

Each section of wire rod or group of sections requires the tubular conduits to have a specific inner dimension of their bores so as to provide the best efficiency.

One or more cooling segments may be actuated in a rolling line, depending on the dimension of the wire rod being processed.

All the above forms part of the state of the art. It is also known that the present trend in rolling lines is to provide at least finishing units capable of a quick change of their rolling rings and/or rolls and of the relative equipment.

This arrangement makes it possible to change very quickly the section of rod to be produced and enables even relatively small batches to be processed economically. This too forms part of the state of the art.

Modern systems for changing the equipment and rolling rings and/or rolls have also made convenient a coordinated adaptation of all the machines and equipment located downstream of the finishing units.

This fact makes it advantageous to equip the cooling line swiftly with tubular conduits suitable for the requirements of a new section of wire rod.

Two methods are being used at present for the re-equipment of the cooling line.

A first method provides for replacement of the whole cooling line; it is necessary in this case not only to have a spare line already equipped but also to have suitable lifting and handling means and to allow a given time for all the connected operations.

A second method provides for the equipment, on each occasion, of only the number of segments required and for the replacement of the components of the individual segments. In this case the replacement times are even longer and have a considerable effect on the production cycle.

The present applicant has designed and tested this invention so as to enable the cooling line to be readied within a short time, without any need for a crane or bridge crane, and to be made suitable to process a new section of wire rod.

According to the invention at least two pluralities of tubular cooling conduits, assemblies to remove water and assemblies to dry the wire rod are arranged on one single structure. Each of these pluralities is organized in segments so that one or more segments can be actuated.

According to one embodiment each of these pluralities comprises support and handling arms pivoted in a coordinated manner along the axis of the plurality on one side or the other of the rolling axis.

The rotation of one of the pluralities about the axis of the arms is made possible by the arms and sets the tubular conduits, and everything else provided for the cooling segment thus actuated, on the same axis as the rolling axis.

According to a variant the pluralities of arms are fixed solidly on one single support able to rotate on one single shaft so as to form, in fact, a rotary drum.

The rolling axis passes along a lateral position coinciding with the cooling axis of each specific plurality of arms when the plurality is located in its working position.

The invention is therefore embodied with a quick-change cooling line to cool rolled wire rod leaving the finishing stands, the cooling line comprising the contents and features of the main claim and one or another of the dependent claims.

The attached figures, which are given as a non-restrictive example, show the following:

FIG. 1 shows the end portion of a rolling line together with the cooling line;

FIG. 2 gives a three-dimensional view of a possible embodiment of the invention;

Figure 1:
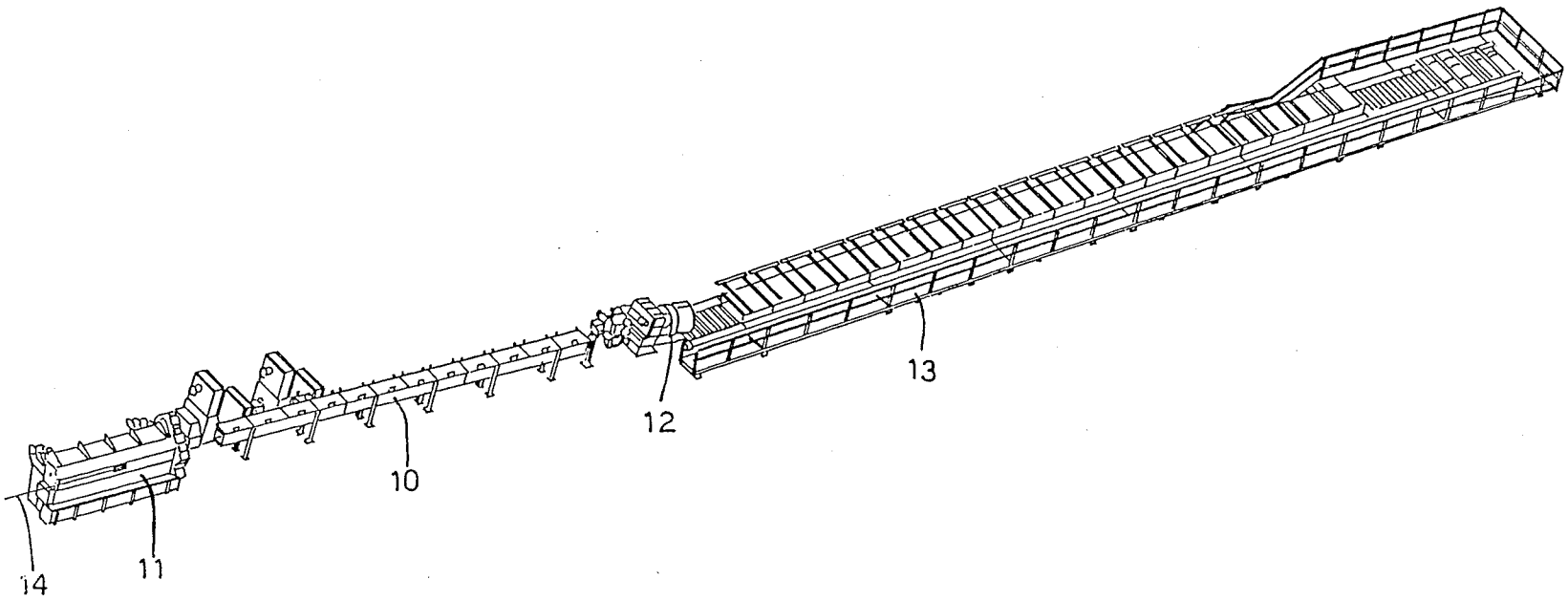

In FIG. 1 end portion of a rolling line comprises here a finishing assembly 11, a cooling line 10, a coiling machine 12 and a bed 13 to cool the coils. The rolling line has an axis 14 for the feed of the rolled stock.

The cooling line 10 consists of segments arranged on one and the same axis and capable of being moved to their working position when so required.

Each segment 110 comprises cooling assemblies 15, assemblies 16 performing cleaning with water and possible drier assemblies 17.

Such division into segments 110 and the structuring of the assemblies 15-16-17 are known in themselves and are taken here as being arranged in the known compositions and forms.

The rolling axis 14 cooperates and indeed coincides with the axis of feed of the wire rod 14.

At least the cooling assemblies 15 and the assemblies 16 performing cleaning with water are fed with water under pressure.

The assemblies 15-16-17 of one segment 110 are prearranged for a limited range of sizes of the wire rod at least as regards the inner diameter of their bore.

If the size of the wire rod is changed so that it becomes greater or smaller than the range of sizes for which the specific segment 110 has been prepared, then the segment itself has to be replaced or else its component assemblies 15-16-17 have to be replaced.

According to the invention at least two specific segments, each of which is pre-arranged for its own determined range of sizes, can cooperate alternately on the axis of feed 14 of the wire rod and in relation to the tract belonging to one segment 110.

Figure 4A:
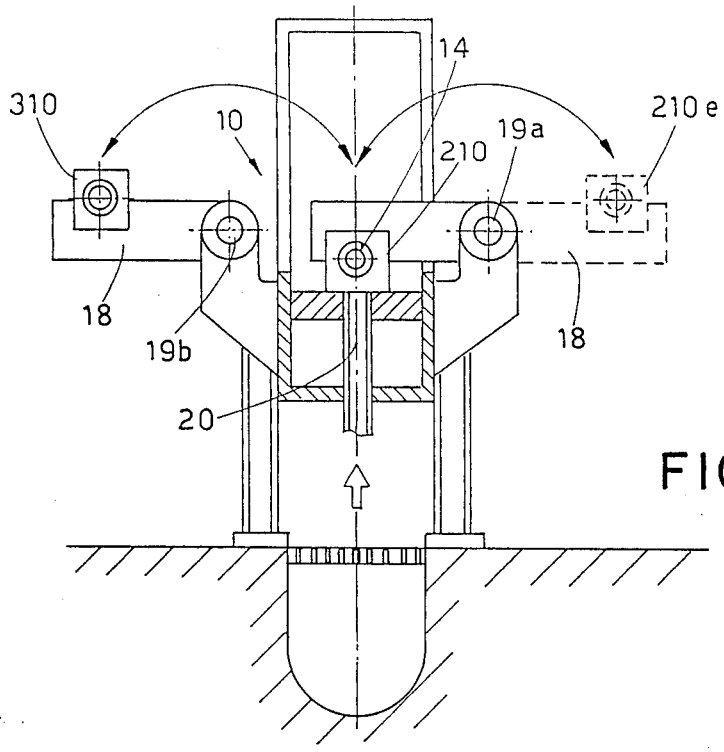
FIGS. 4 and 5 show other possible embodiments according to the invention.

For instance, the specific segment 210 or the specific segment 310 can cooperate on the axis of feed 14 in the embodiment of FIG. 4*a*.

Both the specific segments 210-310 are supported on arms 18 pivoted on shafts 19*a* and 19*b* respectively and can be rotated by 180° in the embodiments of FIGS. 4. Such rotation can be performed by jacks, electric or hydraulic motors or other known systems.

Means 20 to deliver water to the cooling and cleaning assemblies 15-16 are provided in each segment 110.

Such an embodiment enables the specific segment 210 to be moved to 210*e*, for instance, and to be replaced quickly by the specific segment 310, which is already ready for the next size of wire rod to be processed.

While the specific segment 310 is at work and when it is necessary to have another size available, the specific segment 210 located at 210*e* can be re-equipped and have its assemblies 15-16-17 changed wholly or partly.

Figure 4B:
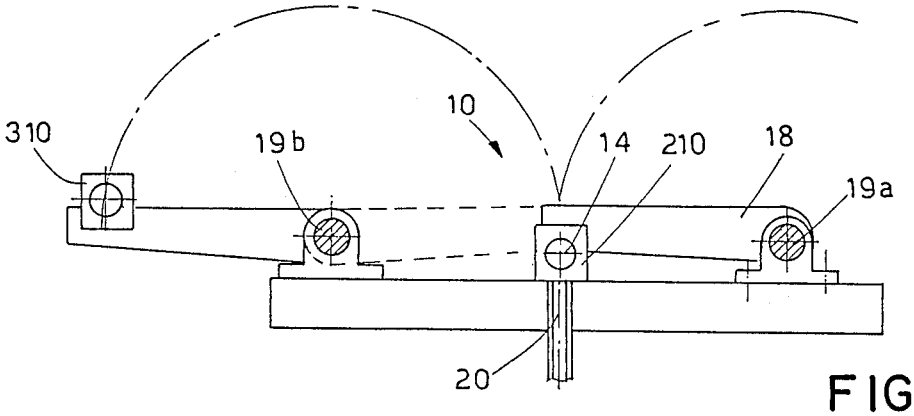

The invention behaves likewise according to the idea of the solution of FIG. 4*b*.

Figure 5:
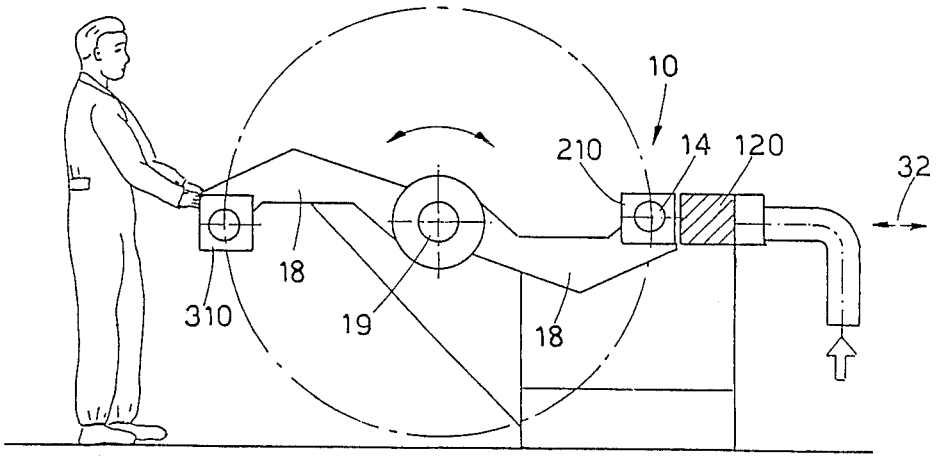

In the embodiment of FIG. 5 too the specific segments 210 and 310 are able to rotate and are supported on the arms 18 but here the arms 18 can rotate about one single rotation shaft 19.

In this instance the means 120 delivering water can move in the directions of the arrows 32 to enable the segment to be rotated and the cooling fluid to be fed.

Three or more specific segments may cooperate with the rotation shaft 19 instead of two specific segments 210 and 310 respectively.

Figure 2:
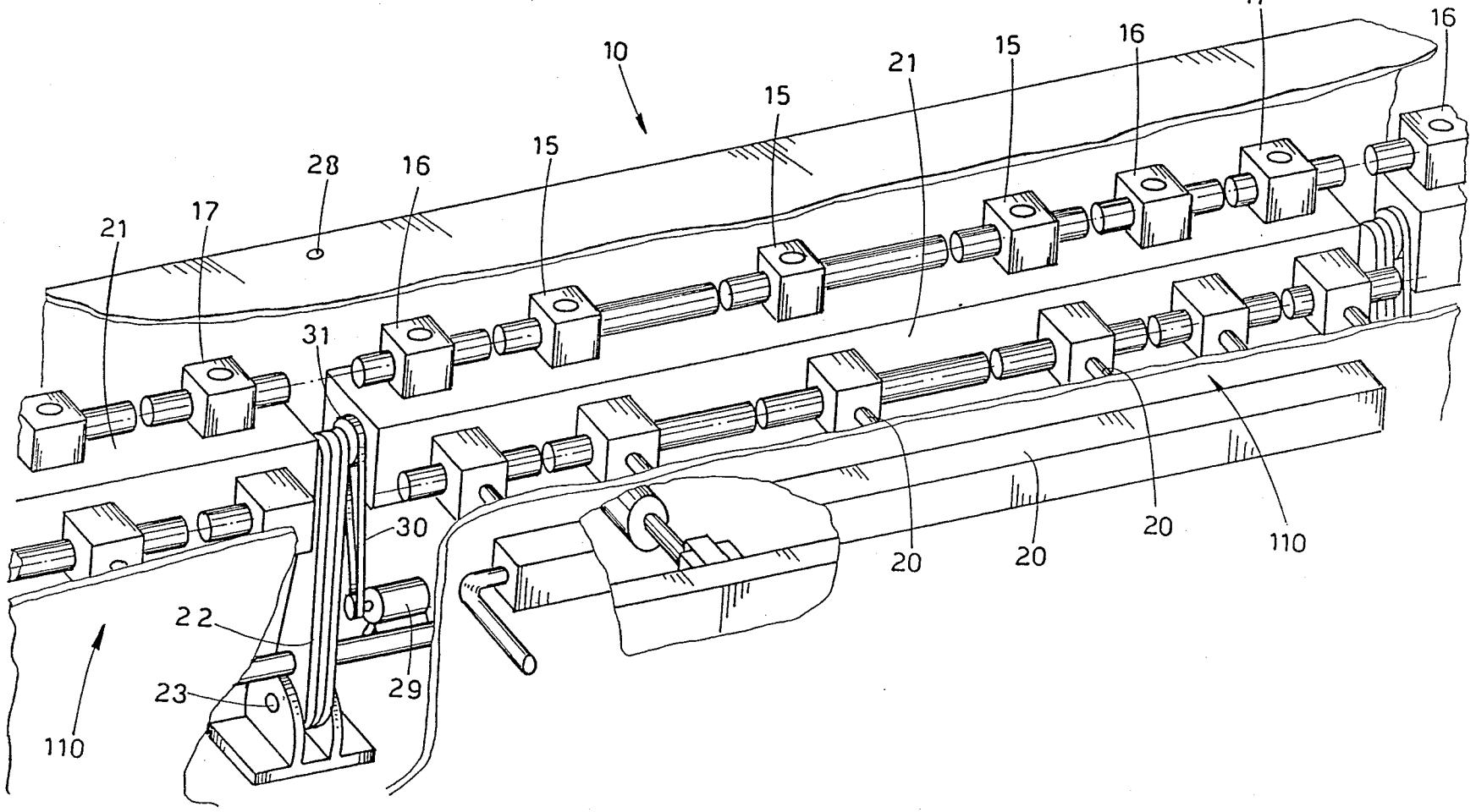
Figure 3:
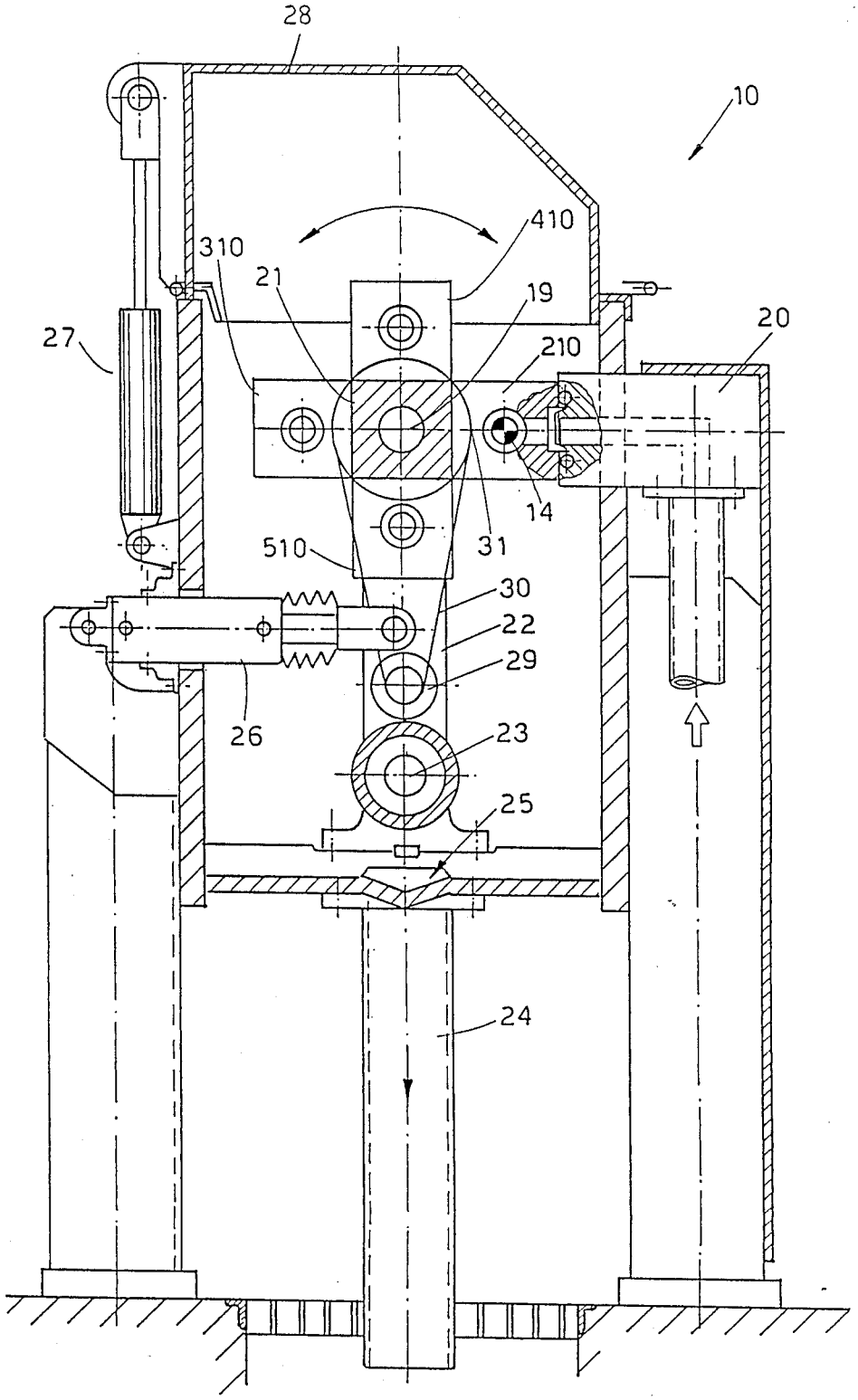
FIG. 3 shows a vertical section of the embodiment of FIG. 1.

In the embodiment of FIGS. 2 and 3 the rotation shaft 19 is supported by support arms 22 which cooperate with a support shaft 23.

A support element 21 is rotatably keyed to the rotation shaft 19 and cooperates in this example with a wheel 31 which gets motion from a motor 29 by means of a belt or chain 30 or another system.

When the motor 29 is actuated, the support element 21 can be rotated by 90° or 180° or more in either direction.

In this example four specific segments 210-310-410-510 respectively are fitted on the support element 21, which in this case has a square section but could have any polygonal section.

When the support element 21 is rotated about the rotation shaft 19, the specific segments 210-310-410-510 are also rotated about the rotation shaft 19.

A jack 26 which can cause the arms 22 to oscillate about the support shaft 23 cooperates with the support arms 22.

So as to position the required specific segment (for instance, 410) in cooperation with the rolling or feed axis 14, the support arms 22 are oscillated backwards by the jack 26 and displace backwards the support element 21 and therewith the specific segment 210, which has just finished working.

In this way the specific segment 210 is freed from engagement with the water delivery means 20 and the support element 21 can be rotated, by 90° clockwise in this example, so as to bring the specific segment 210 to its new working position.

The support arms are caused to swing forwards and the various assemblies 15-16-17 comprising the specific segment 410 come into cooperation with the water delivery means 20, and at the same time the axis of the assemblies 15-16-17 of the specific segment 410 thus positioned coincides substantially with the feed or rolling axis 14.

A cover 28, which can be actuated, for instance, by a jack 27, may be included, and an outlet for water 24 which cooperates with the bottom 25 of the cooling line casing may also be provided.

I claim:

1. A quick-change cooling line located downstream from a finishing unit which is adapted to cool round or ribbed wire rod, comprising:

a plurality of segments each comprising at least two tubular conduits, wherein said at least two tubular conduits comprise a cooling assembly and an assembly for performing cleaning with water; and means for moving each said segment between a cooling position wherein said at least two tubular conduits of the segment are coaxial with a rolling axis of the finishing unit and a maintenance position wherein the segment is accessible for maintenance.

2. A quick-change cooling line as claimed in claim 1, wherein each said segment further comprises a dryer assembly.

3. A quick-change cooling line as claimed in claim 1, wherein each said segment is adapted to cooperate with wire rod of a different range of dimensions.

4. A quick-change cooling line as claimed in claim 1, wherein said means for moving comprises a plurality of pivotable arms movable between said cooling position and said maintenance position.

5. A quick-change cooling line as claimed in claim 4, further comprising means for pivoting said plurality of pivotable arms.

6. A quick-change cooling line as claimed in claim 1, wherein said means for moving comprises a plurality of rotatable arms movable between said cooling position and said maintenance position.

7. A quick-change cooling line as claimed in claim 6, further comprising means for rotating said plurality of rotatable arms.

8. A quick-change cooling line as claimed in claim 7, further comprising means for delivering cooling fluid to said cooling position, wherein said means for delivering cooling fluid is movable between an engaged position and a disengaged position.

9. A quick-change cooling line as claimed in claim 1, wherein said means for moving comprises a support element which is rotatable about a first shaft.

10. A quick-change cooling line as claimed in claim 9, further comprising means for rotating said support element.

11. A quick-change cooling line as claimed in claim 9, wherein said first shaft is supported by at least one support arm and wherein said at least one support arm is pivotable about a second shaft between an engaged position and a disengaged position.

12. A quick-change cooling line as claimed in claim 1, further comprising means for pivoting said at least one support arm.

* * * * *